US010359054B2

(12) United States Patent
Hiernaux

(10) Patent No.: US 10,359,054 B2
(45) Date of Patent: Jul. 23, 2019

(54) VORTEX-INJECTOR CASING FOR AN AXIAL TURBOMACHINE COMPRESSOR

(71) Applicant: Techspace Aero S.A., Herstal (Milmort) (BE)

(72) Inventor: Stéphane Hiernaux, Heers (BE)

(73) Assignee: SAFRAN AERO BOOSTERS SA, Herstal (Milmort) (BE)

( * ) Notice: Subject to any disclaimer, the term of this patent is extended or adjusted under 35 U.S.C. 154(b) by 719 days.

(21) Appl. No.: 15/184,692

(22) Filed: Jun. 16, 2016

(65) Prior Publication Data

US 2017/0058687 A1 Mar. 2, 2017

(30) Foreign Application Priority Data

Jun. 18, 2015 (BE) ..... 2015/5372

(51) Int. Cl.
*F04D 29/68* (2006.01)
*F04D 27/02* (2006.01)
(Continued)

(52) U.S. Cl.
CPC ..... *F04D 29/685* (2013.01); *F01D 11/04* (2013.01); *F01D 11/14* (2013.01);
(Continued)

(58) Field of Classification Search
CPC ..... F04D 29/68; F04D 29/685; F04D 29/682; F04D 29/684
See application file for complete search history.

(56) References Cited

U.S. PATENT DOCUMENTS 7,811,049 B2 * 10/2010 Xu ..... F01D 11/10 415/145
8,066,471 B2 * 11/2011 Bayere ..... F01D 5/143 415/173.4
(Continued)

FOREIGN PATENT DOCUMENTS

DE 102012100339 A1 * 7/2013 ..... F04D 29/684
DE 102012100339 A1 7/2013
(Continued)

OTHER PUBLICATIONS

Bunker—Axial Turbine Blade Tips: Function, Design, and Durability—Journal of Propulsion and Power vol. 22, No. 2, Mar.-Apr. 2006.*
(Continued)

*Primary Examiner* — Justin D Seabe
*Assistant Examiner* — Juan G Flores
(74) *Attorney, Agent, or Firm* — James E. Walton

(57) ABSTRACT

The present application proposes an axial turbomachine compressor comprising a rotor with at least one annular row of rotor blades, a stator casing surrounding the row of rotor blades, the casing including a device for generating counter-vortexes. During operation of the compressor, the movement of the blades creates leakage vortexes at the blade tip. The generating device in turn injects counter-vortexes rotating in the opposite direction to the leakage vortexes in order to counter the leakage vortexes. This improves the surge margin of the compressor. The present application also provides a method for controlling the stability of a turbomachine compressor by counter-vortex injection.

20 Claims, 4 Drawing Sheets

(51) Int. Cl.

| | |
|---|---|
| ***F04D 29/52*** | (2006.01) |
| ***F01D 11/04*** | (2006.01) |
| ***F01D 11/14*** | (2006.01) |
| *F01D 11/10* | (2006.01) |

(52) U.S. Cl.
CPC ..... *F04D 27/0215* (2013.01); *F04D 27/0238* (2013.01); *F04D 29/526* (2013.01); *F01D 11/10* (2013.01); *F05D 2220/32* (2013.01); *F05D 2240/55* (2013.01)

(56) References Cited

U.S. PATENT DOCUMENTS

| | | | | |
|---|---|---|---|---|
| 2005/0226717 | A1 | 10/2005 | Xu | |
| 2011/0299979 | A1 | 12/2011 | Montgomery | |
| 2014/0119883 | A1* | 5/2014 | Kempf ..... | F04D 29/164 415/1 |

FOREIGN PATENT DOCUMENTS

| | | | | |
|---|---|---|---|---|
| EP | 1862641 | A1 * | 12/2007 | ..... F01D 5/143 |
| EP | 1862641 | A1 | 12/2007 | |
| EP | 2108784 | A2 * | 10/2009 | ..... F01D 9/04 |
| EP | 2108784 | A2 | 10/2009 | |
| EP | 2151582 | A2 * | 2/2010 | ..... F04D 29/526 |
| EP | 2151582 | A2 | 2/2010 | |
| EP | 2728196 | A2 | 5/2014 | |
| EP | 2778427 | A2 * | 9/2014 | ..... F01D 5/145 |
| EP | 2778427 | A2 | 9/2014 | |

OTHER PUBLICATIONS

Search Report dated Feb. 1, 2016 for BE 201505372.

* cited by examiner

VORTEX-INJECTOR CASING FOR AN AXIAL TURBOMACHINE COMPRESSOR

This application claims priority under 35 U.S.C. § 119 to Belgium Patent Application No. 2015/5372, filed 18 Jun. 2015, titled "Vortex-Injector Casing for an Axial Turbomachine Compressor," which is incorporated herein by reference for all purposes.

BACKGROUND

1. Field of the Application

The present application relates to leakage vortexes at the rotor blade tips of a turbomachine. More specifically, the present application relates to a casing designed to limit the effect of blade-tip vortexes that limit the stability of an axial turbomachine compressor. The present application also relates to a compressor and an aircraft turbojet.

2. Description of Related Art

An axial turbomachine compressor has alternating rows of rotor blades and stator vanes. The rotation of the rotor and of the blades of same helps to progressively compress the primary flow passing through the turbomachine. However, this compression involves leaks between the rotor blade tips and the surrounding casing. Indeed, mechanical clearance is required at this interface to prevent contact.

During rotation of the rotor, the blade tips sweep the internal surface of the casing and the leaks bypass the blade tips forming vortexes towards the blade lower surfaces. Each vortex creates a blocking zone against the related blade where movement of the fluid is low. In some circumstances, when the speed of the main flow is reduced, the vortex can reach the leading edge of the following blade. This can cause the flow in the blocking zone to be inverted, which may in turn make the compressor unstable. Surge phenomena may occur, which can be prevented using a casing treatment.

Document US2011/0299979 A1 discloses a turbomachine with a compressor. The compressor has a fixed stator and a moveable wheel bearing the annular rows of blades. The stator comprises an outer casing surrounding the rotor blades, said casing having annular grooves corresponding to the blades. These grooves are of variable depth to maintain the stall margin of the compressor. However, the depth and width of each groove increase the blade tip leakages, thereby limiting the compression ratio of the compressor. Moreover, the performance of the turbomachine is reduced.

Although great strides have been made in the area of casings for axial turbomachine compressors, many shortcomings remain.

DETAILED DESCRIPTION OF THE PREFERRED EMBODIMENT

Figure 1:
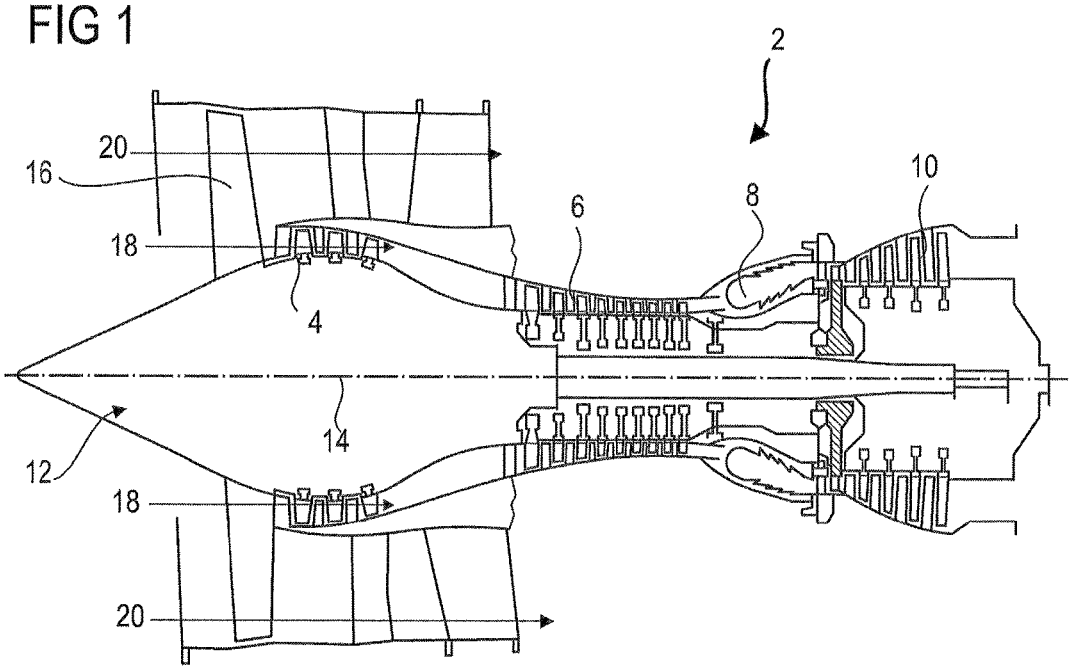
FIG. 1 shows an axial turbomachine according to the present application.

The present application aims to address at least one of the problems presented by the prior art. More specifically, the present application is intended to improve the performance of a turbomachine. The present application is also intended to extend the stall limit of a compressor of an axial turbomachine.

The present application relates to an assembly for an axial turbomachine, in particular for an axial turbomachine compressor, said assembly comprising: a rotor with at least one annular row of rotor blades, a stator casing surrounding the row of rotor blades, the assembly being designed such that, when the turbomachine is in operation, the movement of the blades creates leakage vortexes between the casing and the blades; that is noteworthy in that the casing includes a device for generating counter-vortexes to coincide with the leakage vortexes, the device being designed such that, when in operation, the counter-vortexes turn in the opposite direction to the leakage vortexes they encounter, in order to counter same.

According to a preferred embodiment of the present application, each counter-vortex generating device is designed such that, when in operation, the counter-vortexes have axes of rotation that are primarily parallel to the leakage vortexes, each counter-vortex generating device being preferably installed on the casing.

According to an advantageous embodiment of the present application, the counter-vortex generating device includes orifice injection modules, the casing preferably including several injection modules distributed angularly about the rotor.

According to an advantageous embodiment of the present application, at least one or each injection module has at least one injection orifice positioned upstream of the row of rotor blades.

According to an advantageous embodiment of the present application, at least one or each injection orifice has internal fins designed to generate a counter-vortex from a flow passing through said orifice, and potentially at least one or each module includes several injection orifices with internal fins designed to generate counter-vortexes.

According to an advantageous embodiment of the present application, at least one or each injection module includes a set of injection orifices inclined in relation to one another such as to form a counter-vortex from a flow coming from one of said injection orifices in the set.

According to an advantageous embodiment of the present application, at least one or each injection module includes at least one upstream injection orifice and one downstream injection orifice that are offset axially and/or around the circumference of the casing; said orifices being inclined in relation to one another in an axial plane and/or in relation to a plane perpendicular to the axis of rotation of the rotor.

According to an advantageous embodiment of the present application, at least one or each injection module includes air aspiration means, in particular an air aspiration orifice, potentially positioned downstream of the row of blades.

According to an advantageous embodiment of the present application, at least one or each injection module includes a pair of ducts each linking one injection orifice downstream of the blades to an aspiration orifice downstream of the blades, and the ducts in each pair preferably cross one another.

According to an advantageous embodiment of the present application, the casing includes a main internal surface surrounding the blades, at least one or several or each orifice being flush with said internal surface.

According to an advantageous embodiment of the present application, the blades have leading edges with external extremities, the injection orifices being upstream of the external extremities of the leading edges.

According to an advantageous embodiment of the present application, the counter-vortex generating device includes at least one or several ducts axially passing through the at least one row of rotor blades.

According to an advantageous embodiment of the present application, the counter-vortex generating device includes a one-piece block in which at least one or several ducts are formed, the one-piece block preferably extending along the entire axial length of the at least one annular row of rotor blades.

According to an advantageous embodiment of the present application, the counter-vortex generating device includes a manifold surrounding the casing, the manifold preferably surrounding a space containing the row of blades.

According to an advantageous embodiment of the present application, the assembly includes control means for generating counter-vortexes in an alternative manner depending on a frequency that is a function of the rotational speed of the rotor, and generation of a counter-vortex may be triggered as a function of the proximity of a blade in relation to a generation device.

According to an advantageous embodiment of the present application, a radial clearance separates the external extremities of the blades from the casing, said clearance potentially surrounding the row of blades and/or being an annular clearance.

According to an advantageous embodiment of the present application, the casing includes a ring seal, in particular an annular layer of abradable material, the counter-vortex generating device extending from upstream to downstream of said ring seal and/or surrounding said ring seal.

According to an advantageous embodiment of the present application, at least one or each injection module includes at least one channel linking an injection orifice to an aspiration orifice.

According to an advantageous embodiment of the present application, the assembly includes several generating devices generating counter-vortexes that turn in the same direction.

According to an advantageous embodiment of the present application, at least one or each injection orifice and/or at least one or each aspiration orifice forms a passage oriented primarily radially.

According to an advantageous embodiment of the present application, the main internal surface is the surface with the largest area.

According to an advantageous embodiment of the present application, the manifold is a distributor feeding pressurized air to each counter-vortex generating device.

According to an advantageous embodiment of the present application, the casing has an internal surface with a revolving profile that is usually straight or substantially arched, said profile extending axially along the entire length of a row of rotor blades.

According to an advantageous embodiment of the present application, the counter-vortexes and the leakage vortex flow downstream.

According to an advantageous embodiment of the present application, the counter-vortexes and the leakage vortex each turn on themselves, preferably helically, and/or the leakage vortexes each turn on themselves in a first direction and the counter-vortexes each turn on themselves in a second direction opposed to the first direction.

According to an advantageous embodiment of the present application, the leakage vortexes rotate helically, the device being configured such that in operation counter-vortexes rotate helically in the direction opposite the direction of rotation of helical vortex leak.

The present application also relates to a turbomachine including an assembly that is noteworthy in that the assembly is as claimed in the present application. Preferably, the rotor has several annular rows of blades and the assembly has several counter-vortex generating devices.

The present application also relates to a method for controlling the stability of a compressor of a turbomachine, in particular a low-pressure compressor, the compressor including: a rotor with at least one annular row of rotor blades, a casing surrounding the row of rotor blades, when the turbomachine is in operation, the movement of the blades creates leakage vortexes between the casing and the blades; that is noteworthy in that the method includes the generation of counter-vortexes towards the leakage vortexes and that rotate in the opposite direction to the leakage vortexes in order to limit same.

According to an advantageous embodiment of the present application, the counter-vortexes generated are generated discontinuously, in particular when a leakage vortex approaches.

According to an advantageous embodiment of the present application, the counter-vortexes generated are injected in a downstream direction, in particular towards the leakage vortexes.

According to an advantageous embodiment of the present application, the external extremities of the blades have chords inclined in relation to the axis of rotation of the rotor, and the counter-vortexes have, when generated, helical vortex axes generally parallel to the inclined chords of the external extremities of the blades.

According to an advantageous embodiment of the present application, the assembly is designed for a transonic flow generating a shock in the blades.

In general, the advantageous embodiments of each objective of the present application are also applicable to other objectives of the present application. Where possible, each objective of the present application can be combined with other objectives.

The present application makes it possible to confine the leakage vortexes and possibly to reduce same. The action of same is reduced both in terms of space and duration, with the result that the propagation of same towards the neighbouring blade is stopped. Consequently, each leakage vortex is turned back against the related reference blade. The blocking zone is reduced, and pushed away from the following rotor blade. The stability margin is then increased, while maintaining performance.

The present application makes it possible to retain uniform clearance between the blade and the casing, which improves the compression ratio of each compression stage. The internal surface of the casing also becomes easier to make since it is in this case straight and/or smooth. Construction using a woven preform composite material remains simple.

The use of ducts between the orifices enables the formation of pressure drops therein, which may be dynamic. This makes it possible to control the flow reinjected by the orifices as a function of the pressure difference upstream-downstream of the blades. The vortex generating device can then be adapted to encourage the generation of counter-vortexes at a predetermined operating speed, and to limit such vortexes at other operating speeds. This makes it easier to design a turbomachine that is optimized for a nominal operating speed, while obtaining a self-regulating or passive system.

In the description below, the terms inside or internal and outside or external refer to a position in relation to the axis of rotation of an axial turbomachine. The axial direction corresponds to the direction running along the axis of rotation of the turbomachine.

FIG. 1 is a simplified representation of an axial turbomachine. In this specific case, it is a dual-flow turbojet. The turbojet 2 has a first compression level, referred to as the low-pressure compressor 4, a second compression level, referred to as the high-pressure compressor 6, a combustion chamber 8, and one or more turbine levels 10. When in operation, the mechanical power of the turbine 10 transmitted via the central shaft to the rotor 12 moves the two compressors 4 and 6. These latter have several rows of rotor blades associated with rows of stator vanes. The rotation of the rotor about the axis of rotation 14 thereof thereby enables an air flow to be generated and progressively compressed until it enters the combustion chamber 8. Gearing means may be used to increase the rotational speed transmitted to the compressors.

An inlet fan 16 is coupled to the rotor 12 and generates an air flow that is divided into a primary flow 18 passing through the different levels mentioned above of the turbomachine, and a secondary flow 20 that passes through an annular duct (partially shown) along the machine before re-joining the primary flow at the outlet of the turbine. The secondary flow can be accelerated to generate a thrust reaction. The primary flow 18 and the secondary flow 20 are annular flows, and they are channelled by the casing of the turbomachine. For this purpose, the casing has cylindrical walls or shrouds that may be internal and external.

Figure 2:
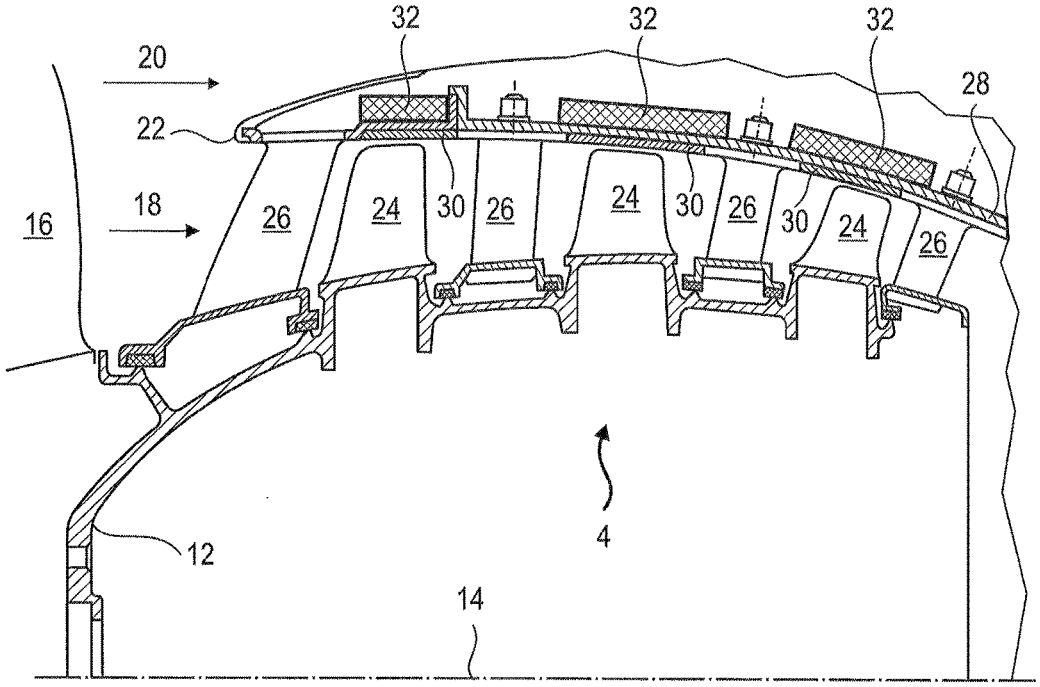
FIG. 2 is a diagram of a turbomachine compressor according to the present application.

FIG. 2 is a cross section of a compressor of an axial turbomachine, such as the one in FIG. 1. The compressor may be a low-pressure compressor 4. A part of the fan 16 and the separator tip 22 of the primary flow 18 and of the secondary flow 20 are shown. The rotor 12 includes several rows of rotor blades 24, in this case three.

The low-pressure compressor 4 includes several guide vanes, in this case four, that each contain a row of stator vanes 26. The guide vanes are related to the fan 16 or to a row of rotor blades to guide the air flow, such as to convert the speed of the flow into static pressure. The stator vanes 26 extend essentially radially from an outer casing 28 and may be fixed to same and immobilized using shafts. They are regularly spaced out in relation to one another and each have the same angular orientation in the flow. The casing 28 may be covered by seals 30, for example abradable seals, level with the rotor blades 24.

In order to retain the stability of the compressor 4, the outer casing 28 is fitted with devices 32 for generating counter-vortexes, each one being associated with a row of rotor blades 24. One or only some of the rows of rotor blades 24 may be provided with generating devices 32.

Figure 3:
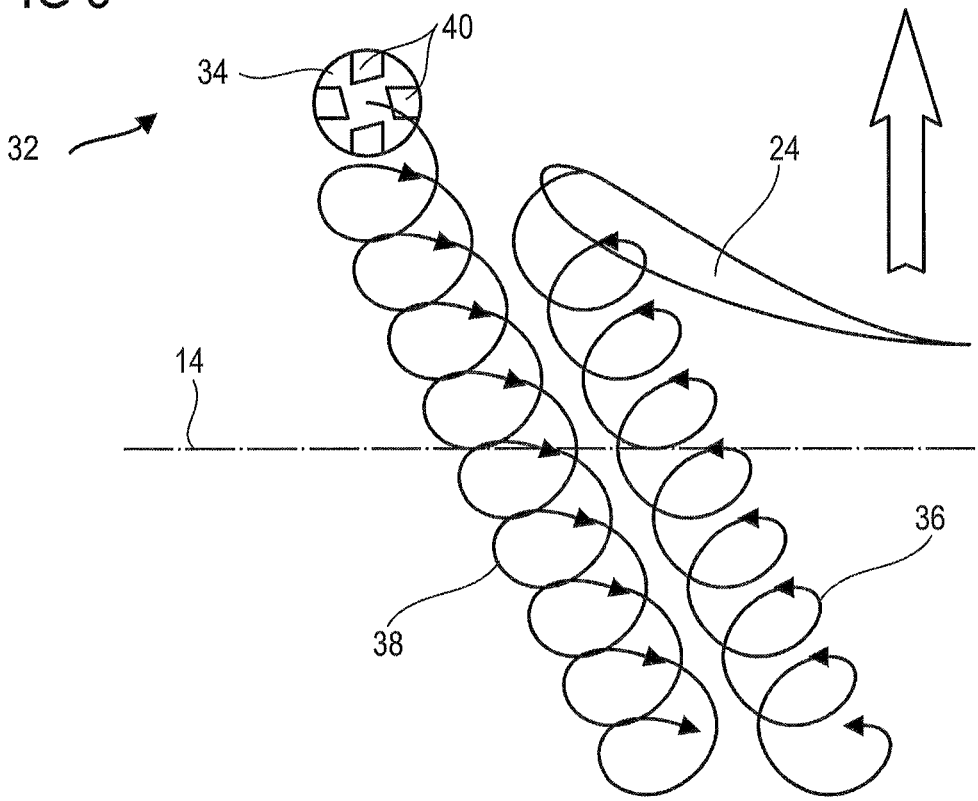
FIG. 3 is a top view of a portion of a compressor with the counter-vortex generating device according to a first embodiment of the present application.

FIG. 3 is a schematic top view of a portion of the compressor. The compressor may be the compressor shown in FIG. 2. A rotor blade 24 is shown axially removed from an injection orifice 34. A leakage vortex 36 is propagated from the tip of the rotor blade.

The device 32 has an orifice 34 for injecting counter-vortexes 38. This counter-vortex 38 rotates in the opposite direction to the direction of rotation of the leakage vortex 36 of the blade. When they meet, the leakage vortex 36 is weakened and the effect of same is countered. The injection orifice 34 may have fins 40. The fins 40 may be helical and distributed angularly inside the orifice 34. The pitch, clearance, height and length of same enable a flow passing through the orifice to be given a rotational component. A vortex such as a counter-vortex is understood to be a spiral flow with a vortex axis potentially forming several successive and consistent spirals.

The air passing through the injection orifice 34 may be aspirated downstream in the compressor. It may also be taken from any other point in the turbomachine. Means may be used to enable a discontinuous feed, for example to enable a counter-vortex to be injected towards a leakage vortex. Consequently, the present application proposes a method for countering leakage vortexes using counter-vortexes 38 injected locally and periodically.

Figure 4:
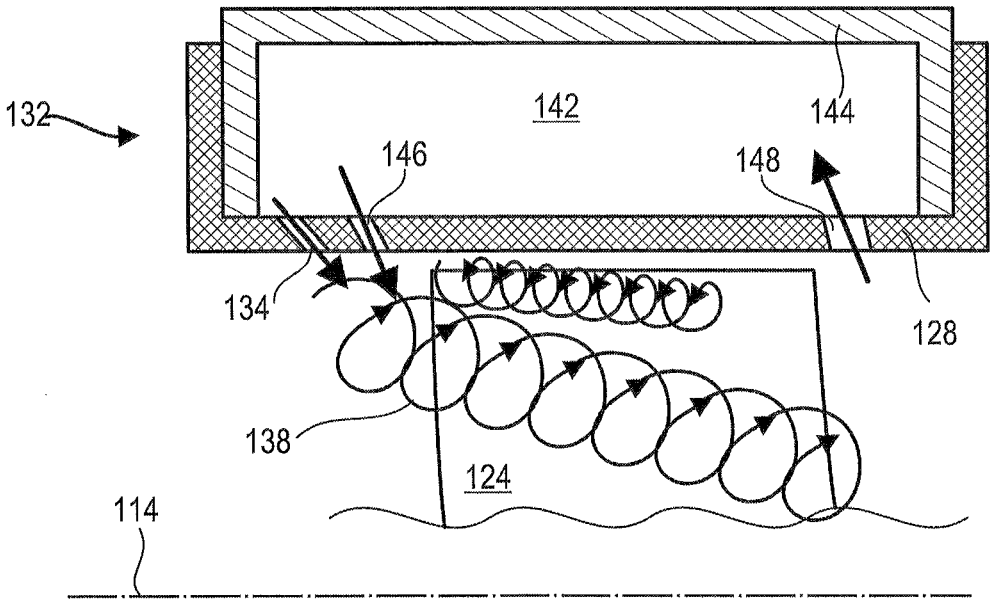
FIG. 4 is a schematic cross section of a portion of a compressor with the counter-vortex generating device according to a second embodiment of the present application.

FIG. 4 outlines a device 132 for generating counter-vortexes 138 according to a second embodiment of the present application. FIG. 4 uses the numbering from the preceding figures for identical or similar elements, although the numbers are each increased by 100. Specific numbers are used for elements specific to this embodiment. The axis of rotation 114 is shown as a marker.

The generating device 132 includes a compressed air manifold 142, the orifices enabling the aspiration and injection of pressurized air. The manifold 142 may form an annular cavity surrounding the row of rotor blades 124, in order to channel the air in an upstream direction. The manifold 142 may be delimited by the casing 128, possibly in the form of an external shroud and/or an external shell 144 attached to the casing 128. The manifold 142 and/or the shell 144 may extend axially along the entire length of the row of blades 124, extending from the leading edge to the trailing edge. The injection orifices may be grouped together in sets of at least two orifices to form a counter-vortex. They can then form an injection module.

The generating device 132 has several injection orifices, including an upstream injection orifice 134 and a downstream injection orifice 146. They communicate with the aspiration orifice 148 via the manifold 142. When the blade 124 moves past the aspiration orifice 148, the pressure increase generates a flow through the manifold 142. This flow enters via the aspiration orifice 148 then leaves via the injection orifices (134; 146). The pressure in the manifold 142 may therefore oscillate on account of the repeated passing of the blades 124.

The device 132 according to this embodiment may be passive in the sense that it does not require the provision of external energy. The device only requires the pressure variation caused by the passing of a blade 124 to work. Reliability and energy efficiency are optimized.

Figure 5:
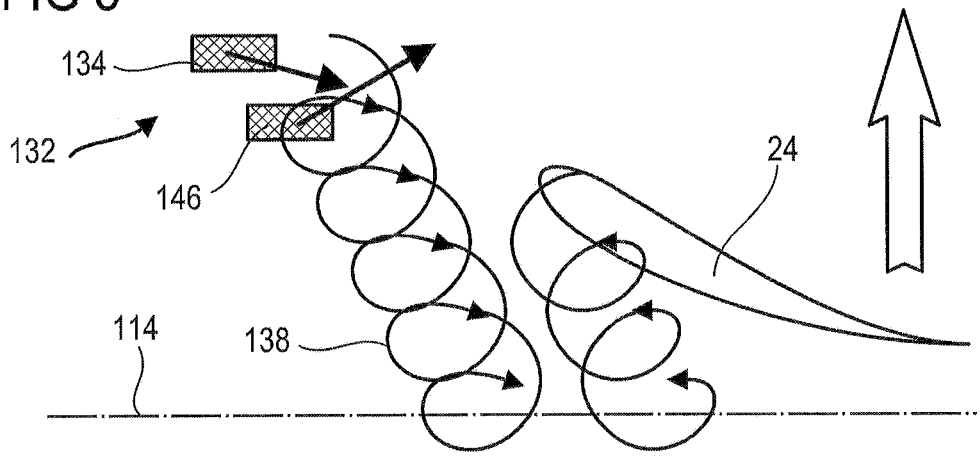
FIG. 5 is a top view of a portion of a compressor with the counter-vortex generating device according to the second embodiment of the present application.

FIG. 5 is a schematic top view of a portion of the compressor according to the second embodiment of the present application. The assembly with a rotor portion and a casing portion shown by the orifices (134; 146) is shown. The axis of rotation 114 is shown as a marker.

The upstream injection orifice 134 and the downstream injection orifice 146 can overlap one another axially and/or around the circumference. They may be rectangle shaped. The offsetting of same and the inclination of the respective output directions of same encourage the formation of a counter-vortex 138. For example, the flows injected rotate about one another, potentially in combination with the primary flow.

Figure 6:
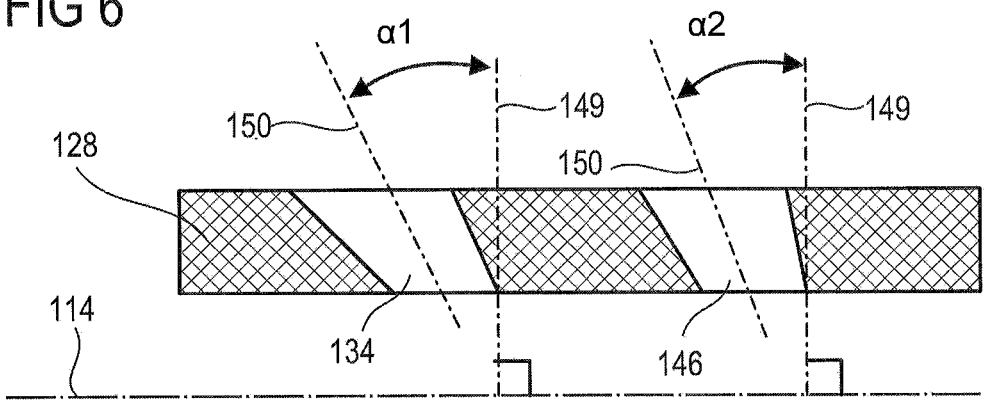
FIG. 6 is an axial cross section of the casing level with a counter-vortex generating device according to the second embodiment of the present application.

FIG. 6 shows an axial cross section of the casing 128. The cross section is taken along the axis of rotation 114. The orifices (134; 146) may match those shown in FIG. 5.

The injection orifices (134; 146) are formed in the thickness of the wall of the casing 128, and pass through same radially. They may be inclined in relation to one another, and/or inclined in relation to straight lines 149 perpendicular to the axis of rotation 114 at different angles. The inclination of an orifice may refer to the direction of the flow passing through same and/or the direction of the medial axis 150 of same. The upstream orifice 134 may be inclined in relation to a perpendicular 149 to the axis of rotation 114 by an angle $\alpha 1$ of between 30° and 50°. The downstream orifice 146 may be inclined in the same direction, but by a lesser angle, for example an angle $\alpha 2$ of between 25° and 45°.

Figure 7:
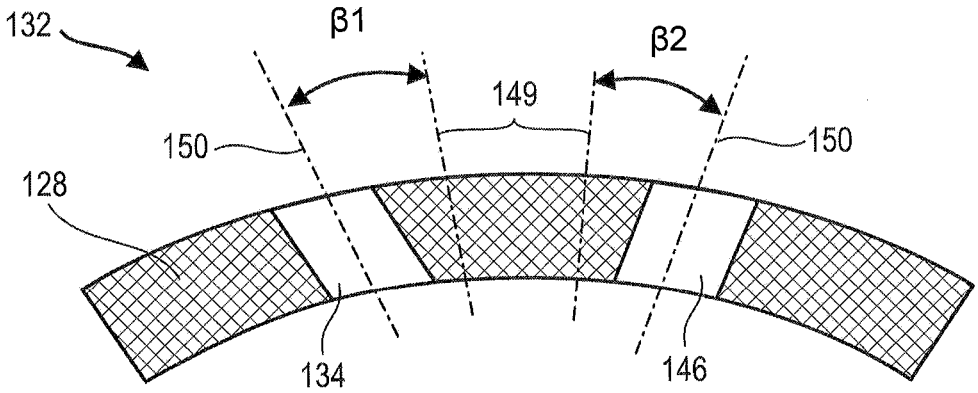
FIG. 7 is a transverse cross section of the casing level with a counter-vortex generating device according to the second embodiment of the present application.

FIG. 7 shows a transverse cross section of the casing 128 level with the generating device 132. The transverse cross section is taken along a plane perpendicular to the axis of rotation. The orifices (134; 146) may match those shown in FIG. 5 and/or FIG. 6.

The injection orifices (134; 146) are inclined within the perpendicular plane. They may be inclined in relation to one another, and/or inclined in relation to a perpendicular 149 to the axis of rotation 114 at different angles. For example, the upstream orifice 134 is inclined in relation to a perpendicular 149 by an angle $\beta 1$ of between 25° and 50° in the direction opposite to the direction of rotation. Optionally, the downstream orifice 146 is inclined in relation to a perpendicular 149 by an angle $\beta 2$ of between 25° and 50° in the direction of rotation of the rotor.

Figure 8:
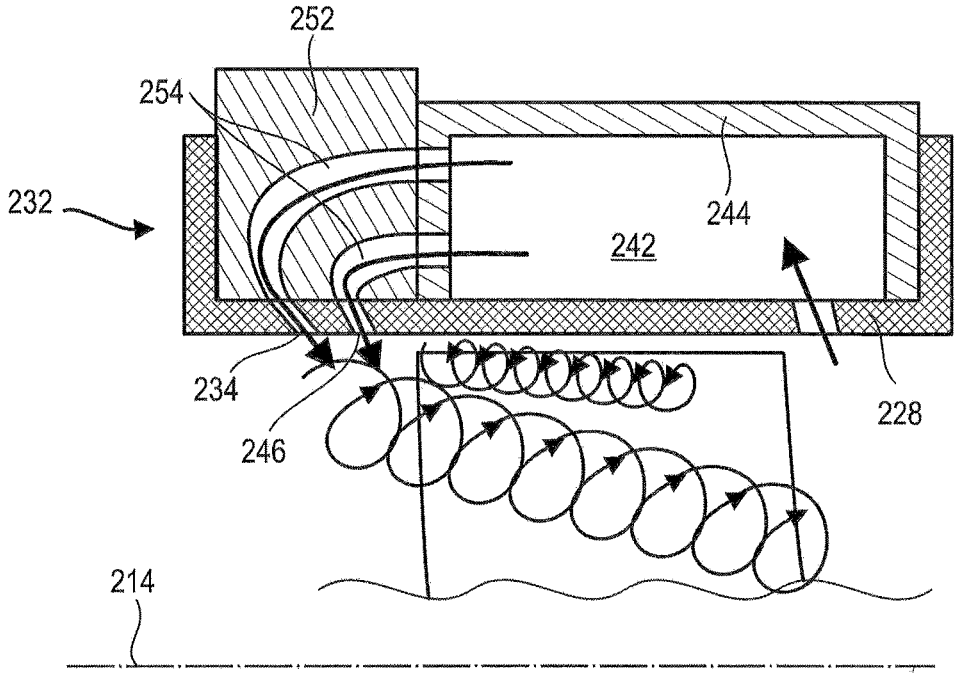
FIG. 8 is a schematic cross section of a portion of a compressor with a counter-vortex generating device according to a third embodiment of the present application.

FIG. 8 is a schematic cross section of the generating device 232 according to a third embodiment of the present application. FIG. 8 uses the numbering from the preceding figures for identical or similar elements, although the numbers are each increased by 200. Specific numbers are used for elements specific to this embodiment. The axis of rotation 214 is shown as a marker.

The generating device 232 may in general be similar to the generating device in the second embodiment of the present application. It also includes a one-piece block 252 attached to the manifold 242, or at least to the shell 244. The block 252 may be attached to the casing 228 and have two ducts 254, each one being in communication with the manifold 242. The ducts (234; 246) each inject flows oriented towards the primary flow. The addition of this block 252 helps to better guide the flows, and therefore to better form a counter-vortex 238. The block 252 may be annular or arc-shaped. It may be made by 3D printing to form ducts 254 having complex geometries. Indeed, the curve and the section of the ducts 254 can be developed.

Figure 9:
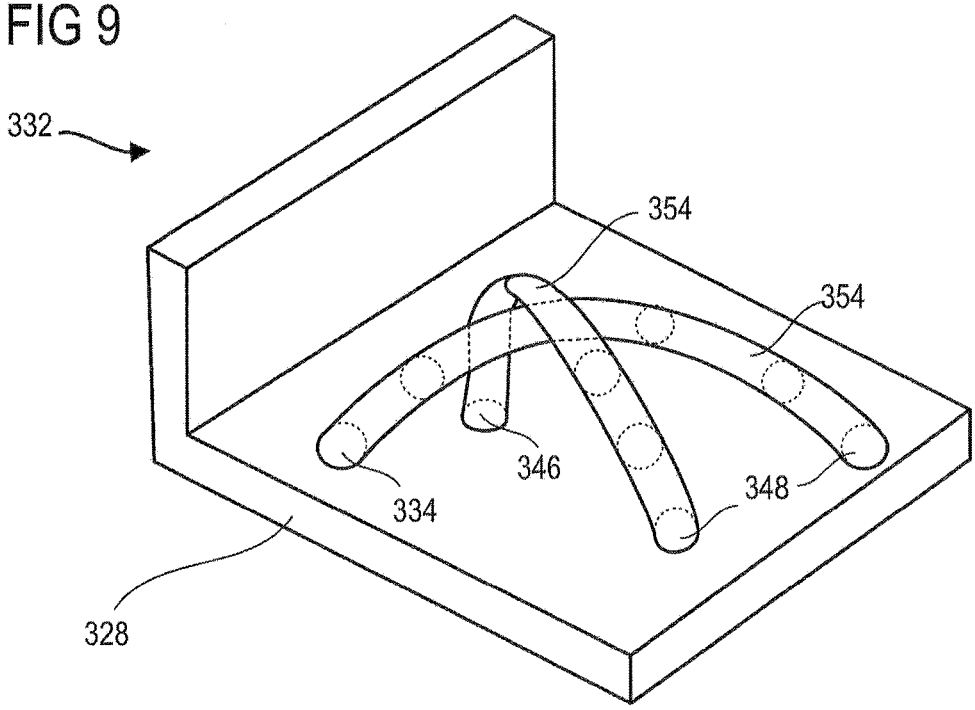
FIG. 9 is an isometric view of a portion of the casing with the ducts of a counter-vortex generating device according to a fourth embodiment of the present application.

FIG. 9 outlines a generating device 332 according to a fourth embodiment of the present application. FIG. 9 uses the numbering from the preceding figures for identical or similar elements, although the numbers are each increased by 300. Specific numbers are used for elements specific to this embodiment.

The injection orifices (334; 346) may also be generally similar to the injection orifices in the second and/or third embodiments. Each orifice (334; 346) may be supplied using a dedicated duct 354. The device 332 may include several aspiration orifices 348, each one in fluid communication by means of a dedicated duct 354. These ducts may be formed using pipes or in a one-piece block. The ducts 354 may cross one another. They may be arranged outside the casing 328.

Alternatively, several ducts communicate with a single aspiration orifice and/or with several injection orifices.

I claim:

1. An assembly for an axial turbomachine, comprising:

a rotor with at least one annular row of rotor blades; and a stator casing surrounding the row of rotor blades;

wherein in operation the rotation of the rotor blades creates leakage vortexes between the casing and the rotor blades; and wherein the casing includes a device for generating counter-vortexes at the level of the leakage vortexes, the device being designed such that the counter-vortexes rotate in the opposite direction to the rotation direction of the leakage vortexes.

2. The assembly according to claim 1, wherein the device for generating counter-vortexes is designed such that, when in operation, the counter-vortexes have axes of rotation generally parallel to the leakage vortexes.

3. The assembly according to claim 1, wherein the device for generating counter-vortexes comprises:

at least one orifice injection module distributed angularly about the rotor.

4. The assembly according to claim 3, wherein the at least one injection module comprises:

at least one injection orifice arranged upstream of the row of rotor blades.

5. The assembly according to claim 3, wherein the at least one injection module comprises:

at least one injection orifice arranged axially level the upstream half of the row of rotor blades.

6. The assembly according to claim 4, wherein the at least one injection orifice has internal fins designed to generate a counter-vortex from a flow passing through the orifice.

7. The assembly according to claim 3, wherein the at least one injection module comprises:

a set of injection orifices inclined in relation to one another such as to form a counter-vortex from a flow coming from one of the injection orifices in the set.

8. The assembly according to claim 3, wherein the at least one injection module comprises:

at least one upstream injection orifice and one downstream injection orifice that are offset axially and around the circumference of the casing, the orifices being inclined in relation to one another in an axial plane.

9. The assembly according to claim 3, wherein the at least one injection module comprises:

at least one upstream injection orifice and one downstream injection orifice that are offset axially and around the circumference of the casing, the orifices being inclined in relation to a plane perpendicular to the axis of rotation of the rotor.

10. The assembly according to claim 3, wherein the at least one injection module comprises:

an air aspiration orifice positioned downstream of the row of blades.

11. The assembly according to claim 3, wherein the at least one injection module comprises:

a pair of ducts each linking one injection orifice disposed upstream the blades to an aspiration orifice disposed downstream the blades.

12. The assembly according to claim 11, wherein the ducts in the pair of ducts cross one another.

13. The assembly according to claim 1, wherein the device for generating counter-vortexes comprises:

a one-piece block in which at least one duct is formed, the one-piece block extending along the entire axial length of the at least one annular row of rotor blades.

14. The assembly according to claim 1, further comprising:

a control unit for generating counter-vortexes in an alternative manner depending on a frequency that is a function of the rotational speed of the rotor, and generation of a counter-vortex is triggered as a function of the proximity of a blade in relation to a generation device.

15. A turbomachine, comprising:

a rotor with at least one annular row of rotor blades; and a stator casing surrounding the row of rotor blades;

wherein, when in operation, the movement of the rotor blades creates leakage vortexes between the casing and the rotor blades, the leakage vortexes turning helically in a first turning direction; and wherein the casing includes a device for generating counter-vortexes at the level of the leakage vortexs, the counter-vortexes turning helically in a second turning direction which is opposed to the first turning direction.

16. The turbomachine according to claim 15, further comprising:

a high pressure compressor; and a low pressure compressor with a low pressure casing, the low pressure casing being the stator casing.

17. A stability control method for a turbomachine compressor, comprising:

providing a rotor with at least one annular row of rotor blades;

providing a casing surrounding the row of rotor blades, such that when the turbomachine is in operation, the movement of the blades creates leakage vortexes between the casing and the blades; and limiting the leakage vortexes by generating counter-vortexes towards the leakage vortexes rotating in the opposite direction to the leakage vortexes.

18. The stability control method according to claim 17, wherein the counter-vortexes generated are generated discontinuously.

19. The method according to claim 17, wherein the counter-vortexes generated are injected in a downstream direction.

20. The method according to claim 17, wherein the external extremities of the blades have chords inclined in relation to the axis of rotation of the rotor, and the counter-vortexes have, when generated, helical vortex axes generally parallel to the inclined chords of the external extremities of the blades.

* * * * *